US005645649A

United States Patent [19]

Cole, Jr.

[11] Patent Number: 5,645,649

[45] Date of Patent: Jul. 8, 1997

[54] METHOD FOR PROPORTIONING THE FLOW OF FOAMING AND DEFOAMING AGENTS AND CONTROLLING FOAM FORMATION

[76] Inventor: Howard W. Cole, Jr., 2745 Waterworks Rd., Danville, Ky. 40422

[21] Appl. No.: 453,789

[22] Filed: May 30, 1995

Related U.S. Application Data

[63] Continuation of Ser. No. 72,916, Jun. 7, 1993, abandoned, which is a continuation-in-part of Ser. No. 831,417, Feb. 5, 1992, abandoned.

[51] Int. Cl.[6] ..... B08B 7/04; B08B 15/00

[52] U.S. Cl. ..... 134/18; 134/25.1; 134/26; 134/27

[58] Field of Search ..... 134/26, 27, 18, 134/25.1, 42; 252/88, 307, 321

[56] References Cited

U.S. PATENT DOCUMENTS

| | | | |
|---|---|---|---|
| 4,028,218 | 6/1977 | Fink et al. | 252/321 |
| 4,400,220 | 8/1983 | Cole, Jr. | 134/18 |
| 4,561,905 | 12/1985 | Kittle | 134/25.1 |
| 4,676,926 | 6/1987 | Kappler | 252/307 |
| 4,971,720 | 11/1990 | Roe | 252/313.1 |
| 5,038,548 | 8/1991 | Sieg | 53/431 |

*Primary Examiner*—Jill Warden

*Assistant Examiner*—Saeed Chaudhry

*Attorney, Agent, or Firm*—Middleton & Reutlinger; David W. Carrithers

[57] ABSTRACT

An invention including an apparatus and process for generating small bubble foam using foam generating equipment in manufacturing processes such as benefication, flotation, flocculation, and for dust control in size reduction processes of a substrate, whereby a continuous, precise amount of a defactant is added to the treated substrate after introduction of the foam and processing of the substrate, in order to neutralize the residual small bubble foam so that the residual foam does not interfere in subsequent processes.

3 Claims, 5 Drawing Sheets

METHOD FOR PROPORTIONING THE FLOW OF FOAMING AND DEFOAMING AGENTS AND CONTROLLING FOAM FORMATION

This application is a continuation of prior application Ser. No. 08/072,916 filed Jun. 7, 1993 now abandoned which is a Continuation-In-Part of U.S. patent application Ser. No. 07/831,417 filed on Feb. 5, 1992 which is now abandoned.

BACKGROUND OF THE INVENTION

The present invention pertains to an apparatus and method for proportioning defactant and surfactant to be used with foam generating equipment to allow continuous, precision proportioning of defactant and surfactant in dust control, benefication, flotation, and flocculation processes. The instant invention also provides a method of controlling the production and flow of foam in process applications by the addition of defactants to deactivate residual surfactants contained in the foam dust control method as set forth in U.S. Pat. No. 4,400,220.

Froth producing compounds, such as ("MICROBOND®", surfactant of the DeTer Company), wetting agents, or foam producing surfactants are used in foam generators to produce the film comprising the small bubble foam.

The term "surfactant", as used herein, refers to surface-active agents which comprise polar compounds consisting of an amphophilic molecule (a molecule with a hydrophilic head attached to a long hydrophobic tail). The hydrophilic group may be anionic, cationic, amphoteric or nonionic. As used in the present invention, the addition of a surfactant to a liquid system reduces the liquid's surface tension and in the presence of gas, promotes foaming. Typical foaming agents include silicone glycols, alkylbenzene sulfonates, alcohol ethoxylates, phosphate esters, betaines, alkylphenol ether sulfates, alkylaryl sulfonates, and other formulations including the foaming agent used in the preferred embodiment MICROBOND® (of the DeTer Company).

The term "defactant", as used herein, refers to surface active agents which causes an increase in the surface tension of the liquid causing the collapse of bubbles in foam. Defoamers commercially available include silicon compounds, alcohols such as methanol or ethanol, and various salts. Specific examples include polypropylene glycols, polyglycol esters, EO-PO copolymers, polydimethyl siloxane sulfonates, ethoxylated fatty alcohols, polyethylene glycol, polysiloxane blends, and dimethyl silicones. Commerically available defoaming agents are also sold under the following trade names: ("ANTIFOAM AF", of Dow Corning Corporation), ("AZ-10A, AZ-20L", A-Z Products, Inc.), ("CC. 101, 103", Custom Chemical Co.), ("ARIZONA 302, 305", Arizona Chemical Co.), ("PLURONIC L-61 SURFACTANT", of BASF Corp., Chemicals Div.), ("OA-5, OA-5U", Cities Service Co.), ("H-10, B ANTIFOAM EMULSION", Dow Corning Corp.), ("AF60, AF70, AF9000, GE10, GE60, GE66, GE70, GE71", General Electric Co.), ("KENNESAW 81", Kennesaw Chemical Corp.), ("FOAMASTER DEFOERS", Henkel Corp.), ("NEPCO 8050, 8171", Diamond-Shamrock Chemical Co.), ("PC-1244" Monsanto Chemical Co.), ("UNITOL ANTIFOAMS", Union Camp Corp.), ("UNITO DSR", Union Camp Corp. ), ("SAG SILICONE ANTIFOAMS", Union Carbide Corp. ), ("WESTVACO L-6", West Virginia Pulp end Paper Co.), and ("PLURONIC L-61, TETRONIC 1101", Wyandotte Chemical Corp.).

The term "foam", as used herein, designates a mixture of liquid, gas, and a surfactant that gives the liquid a film strength which permits the formation of long lasting bubbles when the mixture is agitated to convert it into a mass of bubbles. The liquid used is normally water, and the gas is usually air, because these ingredients are of low cost, but other gas and/or liquid can be used when compatible with the surfactant. The strength of the film depends upon the characteristics of the surfactant, and the amount of the surfactant in the liquid-gas mixture.

Small bubble foam generators are known, as described in U.S. Pat. Nos. 3,811,660 and 4,400,220 which are hereby incorporated by reference. In accordance with U.S. Pat. No. 3,811,660, it is necessary to cause the air, water, and surfactant (surface active material) mixture to be subject to "substantial agitation" to produce small bubble foam. This process is performed by causing the mixture to flow at or above a minimum velocity through a pipe, hose or foamer, a unit having "tortuous passages", or through a foamer as shown in my U.S. Pat. No. 4,207,202.

These generators produce foam with small bubble size at fairly high rates, which is useful for many applications, such as the use of foam for dust suppression. However, many applications for "small bubble" foam require very small flow rates of foam. The apparatus and method for controlling the flow of foam at low flow rates are described in my U.S. Pat. Nos. 4,830,737 and 5,019,244, which are hereby incorporated by reference.

To control dust, it is necessary for the small particle to contact a bubble of the foam and burst the bubble. As the bubble bursts, the gas in the bubble escapes, explodes, and the liquid film of which the bubble was made coats the particle. Particles as small as one micron are readily wetted using the small bubble foam.

The foam produced by the method described in U.S. Pat. Nos. 3,811,660 and 4,400,220 contain small bubble foam. The small bubble foam produced by equipment constructed according to U.S. Pat. Nos. 3,811,660 and 4,400,220 have bubbles from about 50 to 200 micron diameter (0.05 to 0.20 mm) (0.002 to 0.008 inches) when first ejected from the foam generator wherein some of the bubbles coalesce forming bubbles of about (0.015 inches) in diameter. These bubbles exist in a matrix consisting of water and surfactant in the form of highly stressed films surrounding small pockets of air.

The foam bubbles are destroyed by contact with the particles. Generally, finely divided solids suspended in a medium tend to agglomerate wherein the particles touch and form a rather loose and open structure. However, where the dust particles are mixed in with larger particle of various sizes, the wetted particles must then be brought together, made to contact larger particles, or brought into contact with a wetted surface.

For instance, if the foam is injected into a free-falling aggregate (at a transfer point between belts, for example, or injected into a crusher along with the aggregate), the mechanical motion of the aggregate will provide the required particle-to-particle contact. When the foam is injected into an aggregate which is all fines (one to two hundred micron), some means must be provided to cause the wetted particles to coalesce. This is readily accomplished by the use of a cyclone, as disclosed in U.S. Pat. No. 4,000,992.

Minerals such as coal are often subject to numerous flotation and benefication processes to remove impurities and control dust during processing (mining, grinding, transporting, and cleaning). After the initial application of a foaming agent or surfactant to the mineral ore, even though the material may lose its original moisture content, a small amount of surfactant is adsorbed on the mineral particles and remains with the treated material, Additional applications of foaming agents in subsequent processing operations are often ineffective due to incompatibility "chemistry" between the foaming agents. In the case of a flotation or frothing process, if the initial surfactant is similar to chemicals used in the subsequent treatment process, the quantity of surfactant affects the ratio of normally applied chemicals which may reduce the effectiveness of the chemicals and increase the cost of the treatment.

Residual surfactant contained in the small bubble foam also dries forming a film on the mineral ore. Even though the material may lose its original moisture content, the surfactant material is still present. Upon rewetting of the treated material, such as in a flotation process, the surfactant becomes reactivated reducing the surface tension of the water. Agitation of the surfactant containing water tends to form froth and small bubbles. This property has a detrimental effect on the structural strength of a product such as Portland Cement because entrainment of the air bubbles weaken the structural integrity of the cement.

SUMMARY OF THE INVENTION

The present invention pertains to an apparatus and method for proportioning defactant and/or surfactant to be used with foam generating equipment to allow continuous, precision proportioning of defactant or surfactant in dust control, benefication, flotation, and flocculation processes.

A proportioning apparatus is used with a foam generator to provide a surfactant and/or a defactant at a continuous rate in precise proportions to various industrial process operations. The proportioning unit includes an air pump, a water pump mechanically linked to the air pump, a surfactant pump mechanically linked to the air pump and the water pump, a foam generating device for creating small bubble foam, and a defactant pump mechanically linked to the surfactant pump.

The surfactant and defactant pumps are positive displacement piston pumps driven by an adjustable stroke eccentric cam mechanism. The defactant pump and surfactant pump also have variable gear ratios for changing the ratio to proportion the defactant and/or surfactant as required for different chemical processes so that the defactant pump may produce more or less chemical than the surfactant pump.

The defactant pump is driven by a sprocket mechanically linked to the surfactant pump. Both the defactant pump and surfactant pump have a double eccentric cam mechanism and an indicator sleeve with hash marks to indicate the setting of the double eccentric cam mechanism and provides a means of proportioning the volume of the surfactant and defactant applied to the material to be treated.

It is one object of the present invention to provide a method of controlling the production and flow of foam in process applications by the addition of defactants to deactivate residual surfactants contained in the foam film coating.

It is another object of this invention to be able to change this ratio as required between chemical constituencies of surfactant and defactant materials so that the defactant pump may produce more or less chemical than the surfactant pump to accomplish the desired final ratio.

It is yet another object of the present invention to provide a means to vary the actual displacement per revolution of the defactant pump or surfactant pump.

BRIEF DESCRIPTION OF THE DRAWINGS

A better understanding of the present invention will be had upon reference to the following description in conjunction with the accompanying drawings in which like numerals refer to like parts throughout the several views and wherein.

SPECIFICATION

The production and flow of foam in process applications can be controlled by the addition of ("defactants") such as alcohol or silicon to deactivate residual surfactants contained in the foam film. The defactants prevent residual surfactants of foaming agents from reducing the surface tension of water; therefore, it inhibits production of foam. In some applications, the "defactant material" is applied to the process in addition with the application of the Surfactant material. It is necessary that the proper amount of defactant be used to balance or counteract the surfactant applied to the treated material in order to determine the performance of subsequent treatments to the material and to optimize the cost of the treatments. For some applications, it may be beneficial to have excess defactant as compared with the amount of surfactant used in the process of treating the material, for example, in order to control aeration of Portland Cement.

Figure 1:
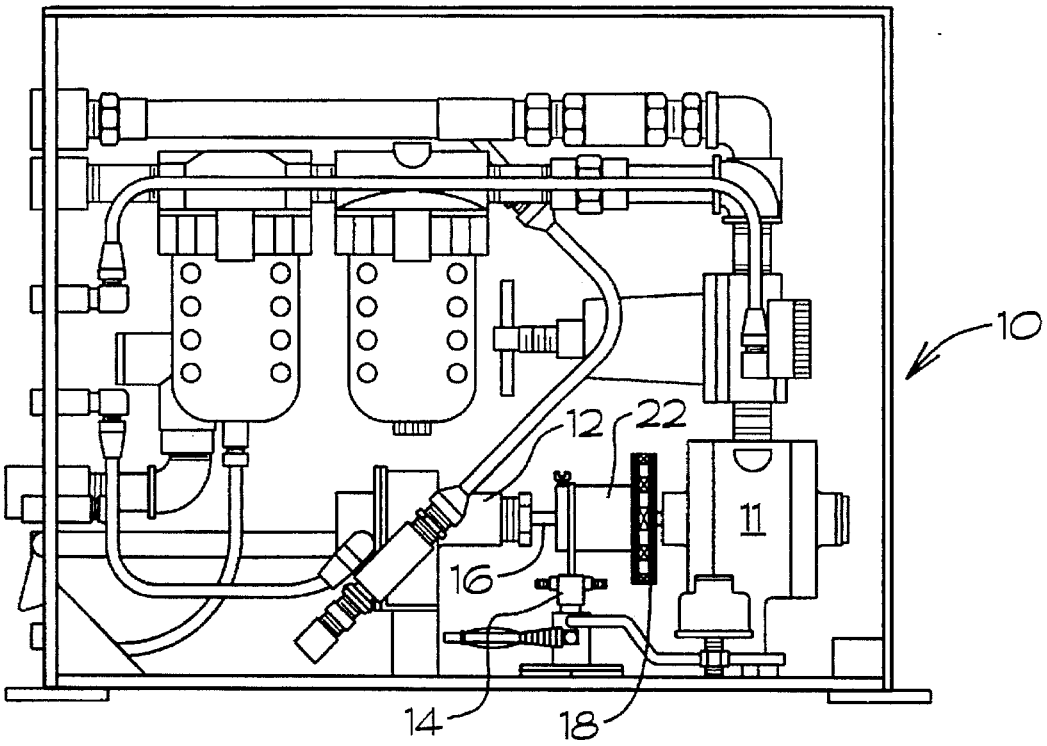
FIG. 1 is a side view of the proportioning unit showing the blending apparatus ("proportioning unit") of the present invention including an air pump, a water pump, and a surfactant pump all connected mechanically by a single main shaft.
Figure 2:
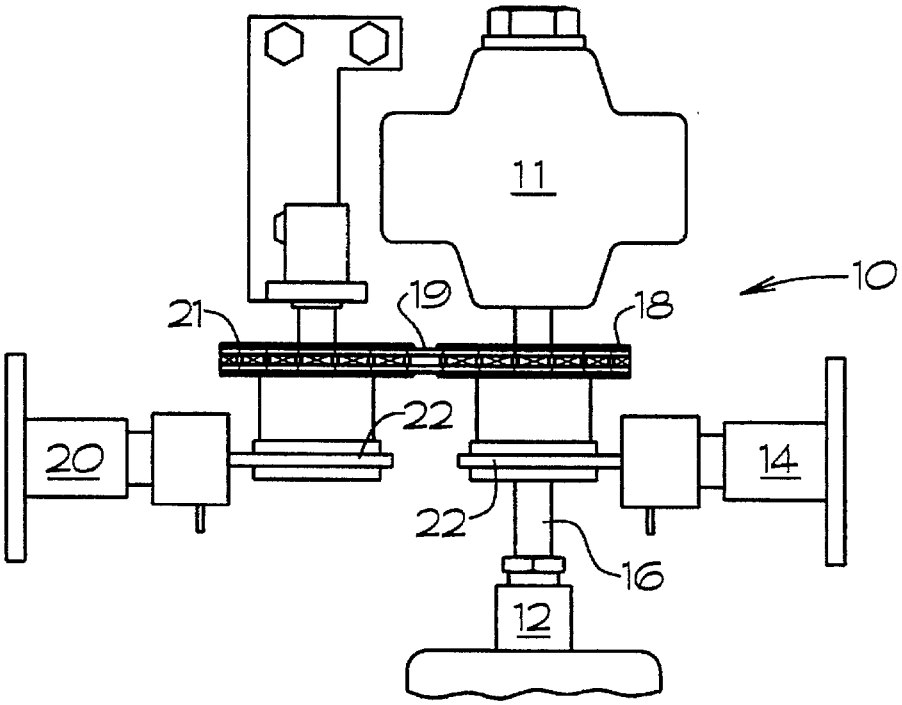
FIG. 2 is a top view of the surfactant pump of FIG. 1 aligned and connected with the water pump and air pump by a common drive shaft.

FIGS. 1 and 2 illustrate the blending apparatus ("proportioning unit") 10 which includes the air pump 11, water pump 12, and surfactant pump 14 all connected mechanically by a single main shaft 16. Both the surfactant pump 14 and the defactant pump 20, as shown in a top view in FIG. 2 are positive displacement piston pumps driven by an adjustable stroke eccentric cam mechanism 22. The eccentric cam mechanism 22, of the surfactant pump 14 is aligned and connected to a common drive shaft 16 which drives the air pump 11, the surfactant pump 14, and the water pump 12 as shown in FIG. 2. A drive sprocket 18 is attached to the main drive shaft 16 between the air pump 11 and the double eccentric drive coupling 22 which drives the surfactant pump 14. The drive sprocket 18 for the surfactant pump 14 is connected by a link chain 19 to the drive sprocket 21 of the defactant pump 20. Drive sprocket 21 is connected to an adjustable eccentric coupling 22 of the defactant pump 20 which is aligned and located to one side of the air pump 11/surfactant pump 14 arrangement. The drive sprocket 21 and chain 19 assembly connecting the defactant pump 20 to the main pump system has a one-to-one ratio, but may be any ratio to establish the proportion of defactant to surfactant for any particular process.

The surfactant pump 14 or defactant pump 20 may be operated independently of one another to pump only surfactant or defactant as required in the treatment process. The actual displacement per revolution of the defactant pump 20 and surfactant pump 14 may be varied to control the quantity of the surfactant or defactant substrate which is pumped to the treated materials. The double eccentric coupling mechanism 22 also provides a means for changing the ratio of the surfactant 14 and defactant 20 pumps to vary the amount of surfactant or defactant materials to obtain the desired blend of materials. The eccentric drive 44 of the present invention is designed to be lubricated by either oil drip or grease methods and to provide the desired output by using a variety of control mechanisms to obtain precise proportionment of the surfactant and defactant used in the process.

Figure 3:
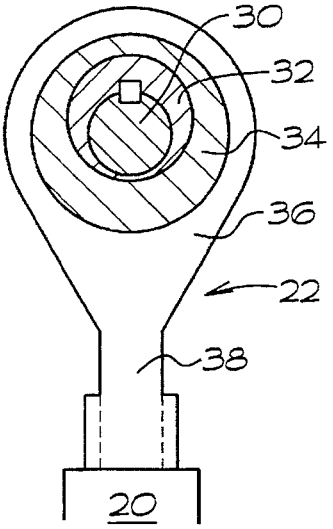
FIG. 3 is a side view showing the double eccentric coupling mechanism used for the defactant and surfactant pumps.

The double eccentric coupling mechanism 22 is shown in FIG. 3, wherein a drive shaft 30 is rotatably disposed within an inner eccentric ½ cam 32, wherein the inner cam 32 is rotatably disposed within an outer ½ cam 34, wherein the outer cam 34 is rotatably disposed within the head 36 of a connecting rod 38 connecting the double eccentric coupling mechanism 22 to the defactant pump 20. Either the inner ½ cam 32, or the outer ½ cam 34 can be rotated individually or in combination to vary the stroke of the defactant pump 20 or surfactant pump 14 and regulate the unit volume of defactant or surfactant being pumped to treat the material.

Figure 4:
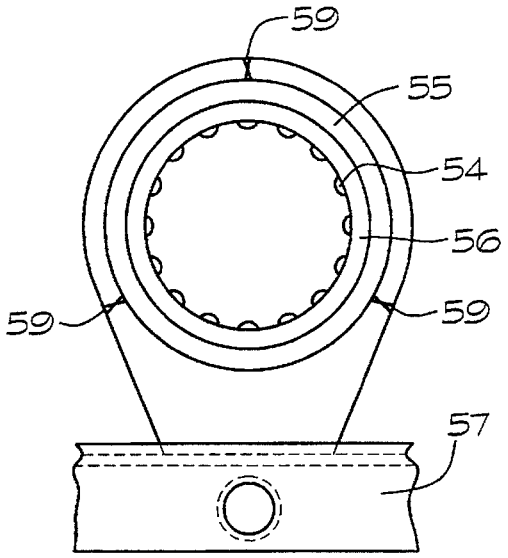
FIG. 4 is a front cut-away view showing the connecting rod and bearing assembly.
Figure 5:
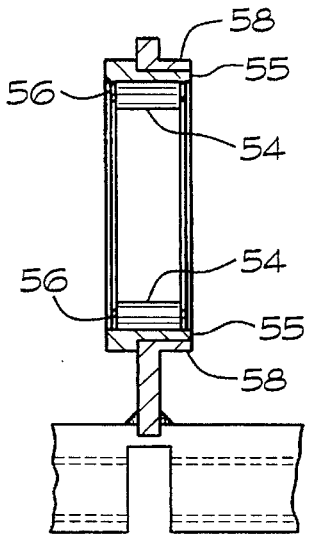
FIG. 5 is a cut-away side view showing the connecting rod and bearing sub-assembly of FIG. 4.

FIGS. 4 and 5 show the connecting rod and bearing assembly for the defactant pump 20. FIG. 4 is a front cut-away view of the connecting rod and bearing assembly showing how the bearing assembly is mechanically linked to the cam assembly. The roller bearings 54 are disposed within the roller cage 56 and supported by the bearing race 55. The bearing race 55 is spot welded at points 59 to the cap 58 which is linked to the connecting rod sub-assembly 57. FIG. 5 shows a cut-away side view of the connecting rod and bearing sub-assembly shown in FIG. 4.

Figure 6:
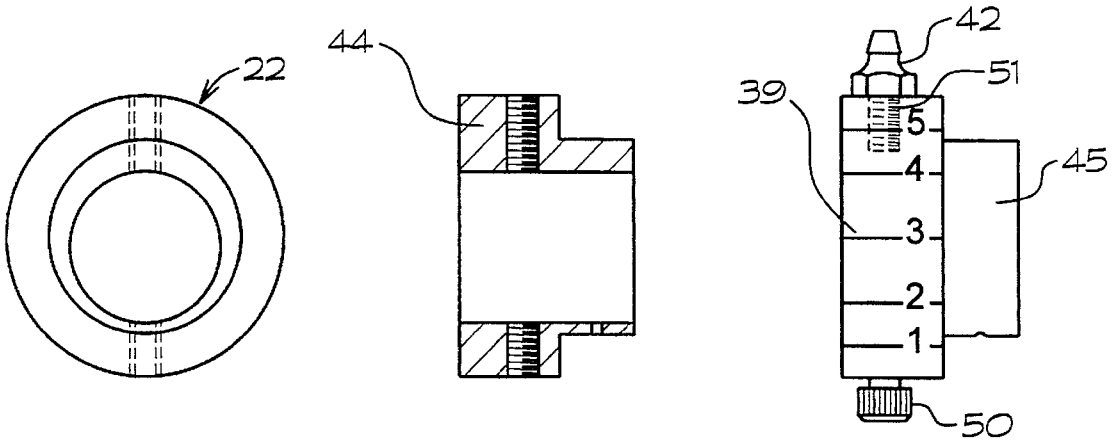
FIG. 6 is an exploded view of the eccentric drive which mechanically links the double eccentric coupling mechanism with the shaft/eccentric coupling, wherein the eccentric cam mechanism is shown in a front view and a side view aligned along a center line disposed within an indicator sleeve covering the eccentric drive.

FIG. 6 shows an exploded view of the eccentric drive 44 which mechanically links the double eccentric coupling mechanism 22 with the shaft/eccentric coupling 45, wherein the eccentric cam mechanism is shown in a front view and a side view aligned along a center line disposed within an indicator sleeve 39 covering the eccentric drive 44.

Figure 7:
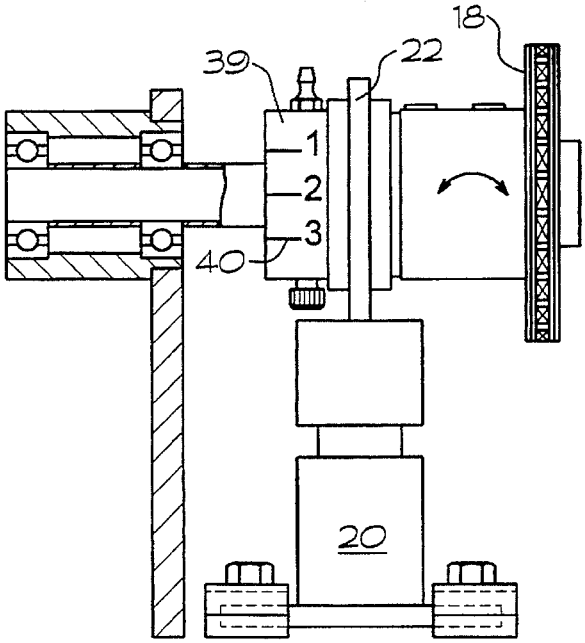
FIG. 7 is a side view showing a defactant pump driven by a sprocket with the double eccentric cam mechanism of FIG. 3 having an indicator sleeve with hash marks.
Figure 8:
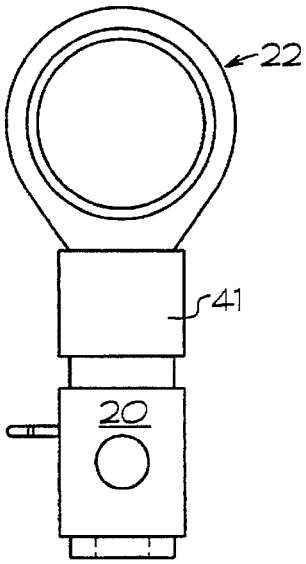
FIG. 8 is a front view showing the defactant pump assembly of FIG. 7.

FIG. 7 shows a typical defactant pump 20 driven by a sprocket 21 and having a double eccentric cam mechanism 22 and an eccentric indicator sleeve 39 with hash marks 40 equally spaced around 180 degrees of the eccentric sleeve 39 to indicate the setting of the double eccentric cam mechanism 22. The marks vary from 0 to 6 to indicate whether inner ½ cam 32 and outer ½ cam 34 are aligned to provide for a full or partial stroke. FIG. 8 shows a front view of the defactant pump assembly of FIG. 7 including the dust shield 41.

Figure 9:
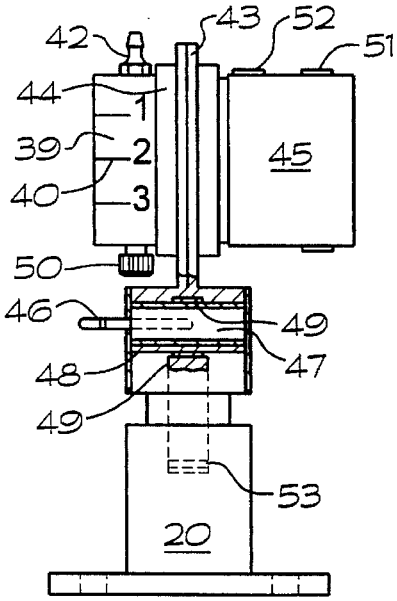
FIG. 9 is a cut-away side view of the defactant metering pump and eccentric drive assemblies.

FIG. 9 shows a cut-away side view of the defactant metering pump 20 and eccentric drive 44 assemblies, including: the grease fitting 42 for the lubrication system, the connecting rod assembly 43, the eccentric drive 44, the shaft/eccentric coupling 45, the oiler pin 46, the piston pin 47, the pump spacer 48, the pump piston 49, the cap screw 50, the set screw 51, the pipe plug 52, and the "O"-ring 53.

The proportioning unit 10 described in the preferred embodiment can be used to proportion surfactant or defactant for use on the material being treated at any point in the process. However, the proportioning unit 10 was designed primarily for use with a foaming device, such as Applicant's patented ("MICROFOAM® Generator") described in U.S. Pat. No. 4,207,202 which produces small bubble foam hereinafter referred to as ("MICROFOAM®"). The raw materials required for the process include air, water, surfactants, and defactants.

Figure 10:
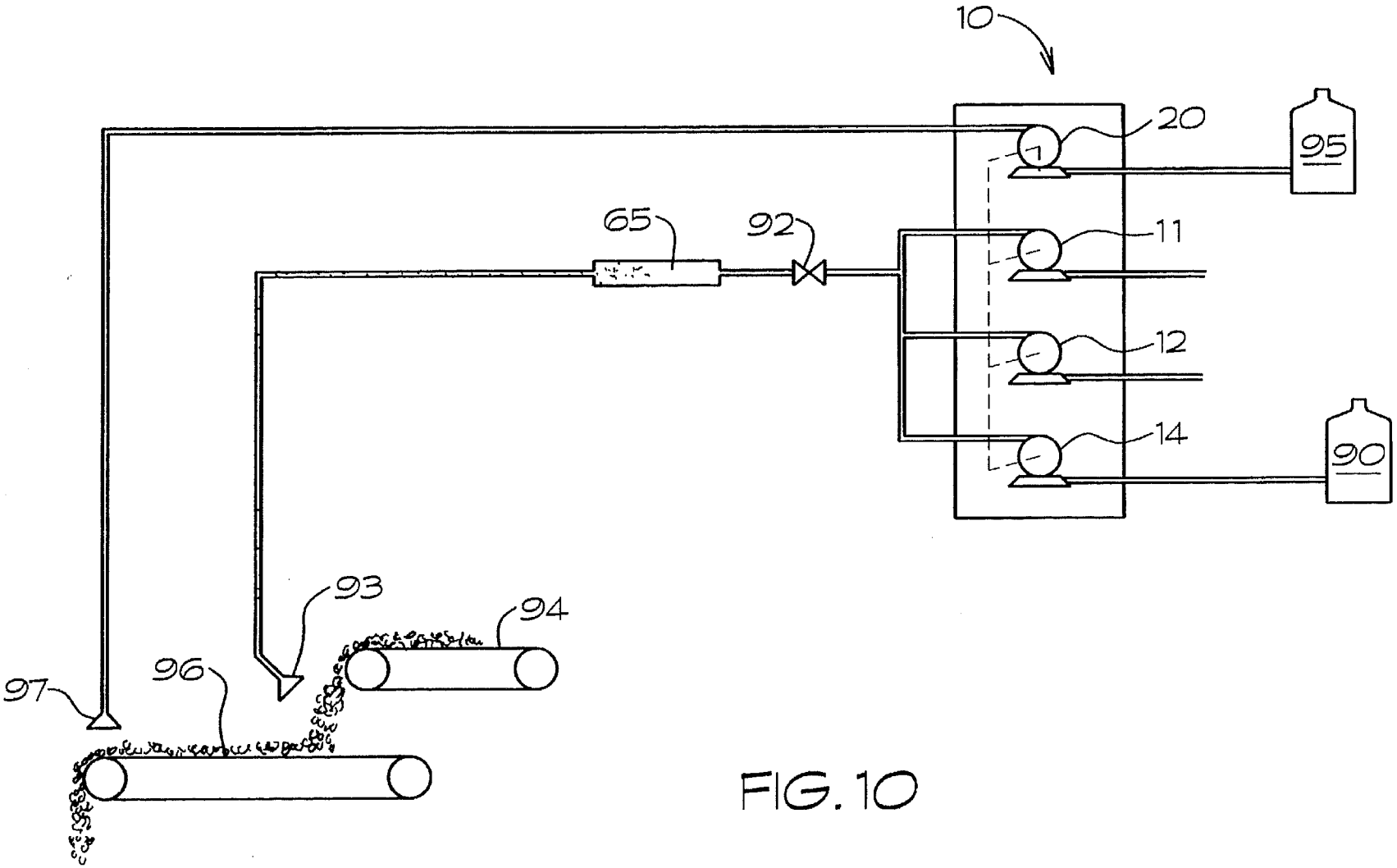
FIG. 10 is a schematic representation of a preferred embodiment of the present invention including a foam generating device, device for controlling the flow of foam, and proportioning unit comprising an air pump, water pump, surfactant pump, and defactant pump.

As best shown in the schematic representation of FIG. 10, air is pumped at approximately 80 to 100 pounds per square inch through air pump 11, water is pumped at 25 to 150 pounds per square inch through pump 12, and surfactant is pumped from a drum 90 through the double eccentric surfactant pump 14 of the proportioning unit 10 to a foam generating unit 65. The air, water and surfactant are all metered and regulated to provide the optimal formulation for producing small bubble foam in the foam generator 65. In the preferred embodiment, the small bubble foam is pumped to a device for controlling the rate of foam such as a valve 92, used after or preferably before the foam generator 65 as shown in the schematic of FIG. 10. Other apparatus, such as the piston/cylinder arrangement described in U.S. Pat. Nos. 4,830,737 and 5,019,244, may also be used to effectively control the rate of foam applied to the substrate.

In the preferred embodiment, MICROFOAM® is pumped at a controlled rate to the point of application through a distribution system using nozzles 93 to spray the foam into the material i.e. coal at a conveyor belt 94 or at other transfer points to control dusting. The foam may also be applied into the dusty material as it is dumped into a holding hopper in order to control dust during the transfer process.

In the process of controlling the fugitive dust, the MICROFOAM® is dissipated (the bubble structure ceases to exist and the water/surfactant content of the MICROFOAM® remains in the material). Before subsequent washing or chemical treatment of the material the defactant is applied to the material using nozzles or any other readily available means to promote contact of the defactant with the material which was previously coated with the foam.

Downstream from the dust control application, a predetermined amount of defactant, determined empirically, is pumped from drum 95 and applied to the material which has been treated with MICROFOAM® containing surfactant. It is not necessary to apply the defactant to all of the material which has been treated with the surfactant, only that the defactant be introduced onto the treated material before any subsequent washing or wetting process. The defactant need not be applied to every particle of treated material. However, the defactant must be applied to the surfactant treated material in an amount necessary to deactivate the surfactant.

For instance, the defactant can be equally distributed across the width of the haulage belt 96 through one or more nozzles 97. As the material is conveyed to a subsequent processing operation such as flotation or frothation bath, the surfactant and defactant chemicals will be mixed in the water solution and neutralized in the water solution.

EXAMPLE I

A particular application in which small bubble foam is needed at low flow rates is called froth flotation. Froth flotation, or benefication as it is sometimes called, is a concentration process for separating the fine valuable minerals from their gauge impurities.

There are many different flotation machines, but all require the formation of some type of air bubbles in the pulp. The size of the air pockets (bubbles) in the pulp is determined by many factors including the air pressure, hole size, agitation of the pulp, etc. In one type of machine, compressed air is introduced under or into the pulp by perforated pipes or by expelling the air through multi-hole plates or fine mesh screens.

It is desirable to have the air pockets as small as possible to more efficiently separate the valuable fine mineral particles from the non-mineral gauge particles. However, present commercial equipment cannot produce air pockets much less than 1/64 inch diameter (0.015"); rather, they normally produce much larger bubbles between 1/32 and 1/4 inch in diameter.

When this foam is introduced into a tank containing a pulp, consisting of ground ore containing fine mineral and non-mineral (gauge) particles, the water film of the mass of bubbles disperses into the water of the pulp, leaving each bubble as a pocket of air surrounded by water. This results in a mass of air pockets which forms a froth which is very effective in entrapping the mineral particles. Thus, using small bubble foam greatly improves the efficiency of the flotation process.

The density (weight per unit volume) of the water into which the very small air pockets are introduced varies with the number of air pockets per unit volume of water. Therefore, it is necessary to accurately control the amount of air in the form of small air pockets introduced into the flotation machines.

To effect benefication, mineral-bearing ores are ground in water to form a mixture of mineral particles and non-mineral gauge particles. The resulting mixture (water, ore, mineral particles, and gauge particles) is conditioned with various chemicals including froth-producing compounds and agitated in flotation machines which introduce and disperse air in the form of bubbles throughout the pulp to liberate the mineral particles from the gauge particles. The bubbles collect at the surface of the pulp as a froth in which the valuable mineral particles are entrapped. The separated minerals are then either skimmed off or overflow with the froth to concentrate tanks, from which the minerals are then extracted for further processing.

Although the surfactant is dissipated (the bubble structure ceases to exist) the surfactant from the foam added to the coal-water slurry adsorbs onto the mineral particles and remains in the material acting as a wetting agent and resulting in a wetter product. Upon subsequent application of water, such as in a flotation process, the surfactant becomes reactivated, reducing the surface tension of the water present, and upon agitation producing froth or bubbles. Residual surfactant may also affect the formulation of other chemicals applied to the minerals in additional processing steps.

Adding defactant at one or more points in the process can eliminate these process problems. A predetermined amount of defactant, determined empirically, is applied to the mineral which has been treated with the surfactant. It is not necessary to apply the defactant to all of the material which has been treated with the surfactant, only that the defactant be introduced onto the treated material before any subsequent washing or wetting process. The defactant need not be applied to every particle of treated material. However, the defactant must be applied to the surfactant treated material in an amount necessary to deactivate the surfactant. As the material is conveyed to the washing operation the surfactant and defactant chemicals will be mixed in the water solution and neutralized in the water solution.

Addition of a defactant with the proportioning unit of the present invention eliminates the problem of concentration of the surfactant and uncontrolled foaming due to the recycling of water. Also, neutralizing the surfactant with a defactant prevents water from adsorbing onto the mineral particles. The defactant added to the mineral particles renders the particles water-repellant and results in a drier product. After neutralizing the surfactant with a defactant, subsequent application of water in a flotation or some other water based process is no longer a problem.

EXAMPLE II

Small bubble foam is often used in mining operations to control dust at the location where the coal is broken loose from the face of the vein, and foam containing surfactant is dispersed in the coal as it is placed on the conveyor which carries it back away from the face of the vein. If dust in the coal has not been previously treated as above, it will be made airborne whenever the coal is discharged from a conveyor to another conveyor. While the mass is loose during transfer, the foam can be discharged from nozzles with a velocity to penetrate the mass of coal and to coat the particles, particularly the dust particles with the surfactant.

Figure 11:
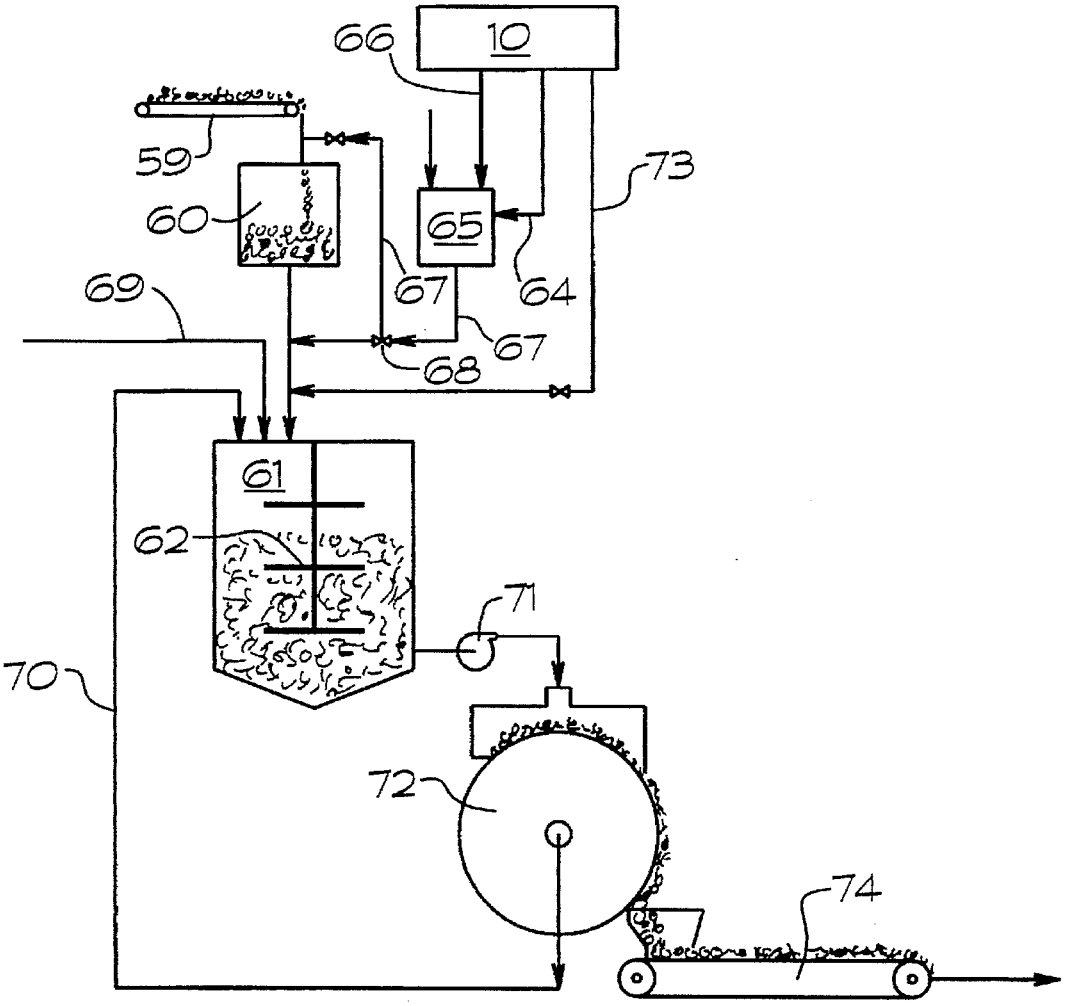
FIG. 11 is a schematic representation of the proportioning unit of the present invention utilized in a coal benefication process to provide foam to control dust and provide a defactant to treat the final product.

As shown in FIG. 11, coal is conveyed and dumped into a coal hopper 60 and transferred to a coal washer 61 having an agitator 62. Air is pumped at high pressure from the proportioning unit 10 of the present invention through transfer line 63 to a foam generating unit 65. Water is pumped from the proportioning unit 10 to the foam generating unit 65 through water line 66. Surfactant is pumped from the surfactant pump 14 of the proportioning unit 10 to the foam generating unit 65 through line 64. Small bubble foam is produced from the water, air, and surfactant in the foam generating unit 65. Wetting, dispersion, and foam-suppression of particles in such slurries are all performed using ethoxylated fatty alcohols, polyethylene glycol, and polysiloxane blends or other surfactants such as DeTer's MICROBOND®. The small bubble foam is pumped to the point of application through line 67 and through a distribution system using nozzles (not shown) to spray the surfactant onto the coal as the coal is conveyed through the transfer system and dumped into the coal hopper 60 from the conveyor 59 to effectively eliminate fugitive and respirable dust. The foam may also be applied onto the coal as it is dumped from the coal hopper 60 into the coal washer 61 in order to control dust during the transfer process. Water is added to the coal washer 61 through line 69 and recycle water line 70.

The coal slurry is pumped through pump 71 to a top-feed vacuum drum 72 where the water is vacuumed through the outer surface of drum into the inside where it is recycled through the coal washer 61. The coal filter cake in the coal washer will often contain unacceptably high levels of moisture. The dewatered coal is then usually conveyed to a dryer.

Several problems occur because of the residual surfactant remaining with the coal. The residual surfactant contained in the recycled wash water pumped to the coal washer 61 results in excess and uncontrolled foaming during the washing process. Although the surfactant is dissipated (the bubble structure ceases to exist) the surfactant added to the coal-water slurry is adsorbed onto the coal particles and remains in the material acting as a wetting agent and resulting in a wetter product. Upon subsequent application of water, such as in a flotation process, the surfactant becomes reactivated, reducing the surface tension of the water present, and upon agitation producing froth or bubbles. In the case of a flotation or frothation process, if the surfactant is similar to chemicals used in the process, it affects the ratio of normally applied chemicals.

Adding a defactant at one or more points in the process can eliminate process problems and be very cost effective. A defactant may be added to the coal slurry to neutralize surfactant foam and produce a drier filter cake to significantly reduce the cost of the dry coal. Downstream from the dust control application, a predetermined amount of defactant, determined empirically, is applied to the mineral which has been treated with the surfactant. It is not necessary to apply the defactant to all of the material which has been treated with the surfactant, only that the defactant be introduced onto the treated material before any subsequent washing of wetting process. The defactant need not be applied to every particle of treated material. However, the defactant must be applied to the surfactant treated material in an amount necessary to deactivate the surfactant. As the material is conveyed to the washing operation the surfactant and defactant chemicals will be mixed in the water solution and neutralized in the water solution.

If the foam is only applied before coal is transferred to the coal hopper, an effective point of application of the defactant is before the coal is mixed in the coal washer 61. This prevents excess foaming during the mixing process. The defactant is most effective if applied through a distribution system of nozzles directly onto the coal to neutralize the foaming action of the surfactant in the coal washer 61. Application of the defactant eliminates the problem of concentration of the surfactant and uncontrolled foaming in the coal washer 61 due to the continued recycling of wash water. Also, neutralizing the surfactant with a defactant prevents the coal-water slurry from adsorbing onto the coal particles. The defactant added to the coal-water slurry renders the coal particles water-repellant and results in a drier product. After neutralizing the surfactant with a defactant, subsequent application of water in a flotation or some other water based process is no longer a problem.

EXAMPLE III

Flocculation of slurries (i.e. paper pulp) using polyelectrolytes is known to accelerate pettling and filtration by increasing the size of particles. However, foam containing surfactants is often used as a means to control dust in transporting and processing the raw material (i.e. wood and dry raw materials) used to produce the paper pulp. The use of defactants to neutralize the residual surfactant contained in the dried foam film can further increase the degree of dewatering in filtration by introducing the effects of hydrophobicity and capillary phenomena into the filter cake structure.

A defactant when added to a slurry, is preferentially adsorbed onto the particle surfaces and orientates itself so that its hydrophobic group extends outward from the particle. This orientation makes the particles hydrophobic, and because of this, they repel themselves rapidly and vigorously away from the water phase. In addition, the defactant significantly increases the surface tension of the liquid and that of the liquid-solid interface, which greatly enhances the drainage of the water through the interstices of the filter cake. Therefore, the degree of dewatering obtained far exceeds that obtained with simple pressure or vacuum filtration alone. Common defactants used in flocculation processes include sulfosuccinates, phosphate esters, and quaternary ammonium salts.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims.

I claim:

1. A method for proportioning a flow of foaming and defoaming agents and controlling foam formation on a substrate, comprising the steps of:

supplying a controlled quantity of water, air, and at least one selected surfactant foaming agent;

metering at least one surfactant foaming agent;

mixing said air, said water, and said selected surfactant foaming agent under pressure using a foam generating device generating a quantity of small bubble foam containing residual surfactant;

continuously applying said small bubble foam containing said residual surfactant in a selected quantity at a selected rate of flow to a substrate having dust particles, treating said substrate and said dust particles and controlling a formation of dust, whereby said substrate adsorbs a small amount of residual surfactant on a surface thereof forming a foam treated substrate determining an amount of residual surfactant foaming agent remaining on said foam treated substrate;

determining an amount of a selected defactant selected from the group consisting of methanol, ethanol, polypropylene glycol, polyglycol esters, ethyleneoxide and propyleneoxide copolymers, polydimethyl siloxane sulfonates, ethoxylated fatty alcohols, polyethylene glycol, polysiloxane blends, dimethyl silicone, thereof;

proportionally applying at a continuous rate at least one selected defactant to said foam treated substrate in a predetermined proportion based upon the amount of said residual surfactant foaming agent remaining on said foam treated substrate for neutralizing said residual surfactant foaming agent remaining on said foam treated substrate prior to mixing said foam treated substrate with an aqueous solution.

2. The method of claim 1, including the step of metering said surfactant foaming agent by means of at least one variable output positive displacement pump.

3. The method of claim 1, including the step of proportionally applying said defactant defoaming agent by means of at least one variable output positive displacement pump.

* * * * *